US012409992B2

(12) United States Patent
Dunwoody

(10) Patent No.: US 12,409,992 B2
(45) Date of Patent: Sep. 9, 2025

(54) COATED METAL CLOSURES

(71) Applicant: CROWN PACKAGING TECHNOLOGY, INC., Alsip, IL (US)

(72) Inventor: Paul Robert Dunwoody, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 219 days.

(21) Appl. No.: 15/743,790

(22) PCT Filed: Jul. 8, 2016

(86) PCT No.: PCT/GB2016/052055
§ 371 (c)(1),
(2) Date: Jan. 11, 2018

(87) PCT Pub. No.: WO2017/009607
PCT Pub. Date: Jan. 19, 2017

(65) Prior Publication Data

US 2018/0208376 A1 Jul. 26, 2018

(30) Foreign Application Priority Data

Jul. 13, 2015 (GB) ..... 1512217

(51) Int. Cl.

| | |
|---|---|
| ***B65D 65/42*** | (2006.01) |
| ***B21D 51/48*** | (2006.01) |
| ***B21D 51/50*** | (2006.01) |
| ***B65D 41/00*** | (2006.01) |
| ***B65D 41/04*** | (2006.01) |
| ***B65D 41/16*** | (2006.01) |

(Continued)

(52) U.S. Cl.
CPC ..... *B65D 65/42* (2013.01); *B21D 51/48* (2013.01); *B21D 51/50* (2013.01); *B65D 41/00* (2013.01); *B65D 41/0442* (2013.01); *B65D 41/16* (2013.01); *B65D 51/145* (2013.01); *B21D 51/46* (2013.01); *B65D 41/005* (2013.01)

(58) Field of Classification Search
CPC ..... B21D 51/46; B21D 51/48; B21D 51/50; B65D 41/00; B65D 41/023; B65D 41/04; B65D 41/12; B65D 41/0457; B65D 41/005; B65D 41/0442; B65D 41/0471
USPC ..... 215/349, DIG. 2, DIG. 4, 347
See application file for complete search history.

(56) References Cited

U.S. PATENT DOCUMENTS 3,361,281 A * 1/1968 Kehe ..... B65D 41/12 215/328
3,633,781 A * 1/1972 Zapata ..... B65D 41/12 215/328

(Continued)

FOREIGN PATENT DOCUMENTS

EP 2228152 A1 9/2010
WO WO 2010/136414 A1 12/2010

*Primary Examiner* — Anthony D Stashick
*Assistant Examiner* — Raven Collins
(74) *Attorney, Agent, or Firm* — Condo Roccia Koptiw LLP

(57) ABSTRACT

A metal closure (1) comprising a panel (10) and a depending side wall (14) terminating in a cut edge (15), the inner surface of the closure having a plurality of coating layers applied (21-27) such that at least one of the coating layers extends to the cut edge and the coating thickness at and in proximity to the cut edge is less than the thickness at one or more other regions of the inner surface.

15 Claims, 3 Drawing Sheets

(51) Int. Cl.
*B65D 51/14* (2006.01)
*B21D 51/46* (2006.01)

(56) References Cited

U.S. PATENT DOCUMENTS

| | | | | | |
|---|---|---|---|---|---|
| 4,020,966 | A * | 5/1977 | Wszolek | B65D 41/12 | 215/349 |
| 4,157,143 | A * | 6/1979 | Doi | B65D 41/12 | 215/228 |
| 4,165,009 | A * | 8/1979 | Murayama | B65D 53/04 | 215/230 |
| 4,552,279 | A * | 11/1985 | Mueller | B65D 41/0457 | 215/318 |
| 2008/0110891 | A1 * | 5/2008 | Carballido | B65D 41/125 | 220/309.1 |
| 2009/0236353 | A1 | 9/2009 | Martin et al. | | |

* cited by examiner

COATED METAL CLOSURES

CROSS-REFERENCE TO RELATED APPLICATIONS

This application is the National Stage of International Application No. PCT/GB2016/052055, filed Jul. 8, 2016, which claims the benefit of GB application number 1512217.9, filed Jul. 13, 2015, the disclosures of which are incorporated herein by reference in their entirety.

TECHNICAL FIELD

This invention relates to coated metal closures for a food and beverage containers.

BACKGROUND

Many types of metal closure or "lids" are known for food or beverage containers. A common class of closure comprises a generally circular panel region and a downwardly dependant skirt, and have a ring of sealing material applied to the underside of the panel region in order to form a seal onto the rim of a container. Such closures are typically manufactured from sheet metal that has been provided with layers of (typically organic) coatings, and are drawn from a circular blank that has been cut from the coated sheet. The drawing process comprises clamping the blank with pressure between an annular draw die and an annular pressure ring, and pushing it over a circular central block. Annular features such as tamper-evident buttons and channels to accommodate the sealing material are formed at the end of the movement of the drawing operation by tools opposing the central block. Such closures may then have lugs or threads formed on the skirt to engage with the container, and curls to hide the edge of the metal. Two-part easy-open closures may also be manufactured from a single-part metal blank as described in EP2228152A1.

The coatings provided on the side of the sheet metal, and that will become the internal surface of the cap, commonly comprise more than one layer, in which case a base-coat is first applied and cured, then any intermediate coats are applied and cured, before a top-coat is applied and cured. These coatings are designed to prevent undesirable chemical reactions such as corrosion of the metal and contamination of the product. The coatings must withstand the process of drawing the sheet metal to form the skirt and the forming any other features such as threads, curls or lugs, and so must be flexible and must have sufficient lubricity. The coatings must also allow the sealing material to adhere. The coatings must avoid contamination or taint of the product, and must also comply with legislation. It is expensive to simultaneously meet all these requirements.

The relatively great total thickness of the coatings can lead to the creation of particles or hairs of coatings during cutting of the blanks (blanking) and drawing. A well-known solution to avoid such hairs or particles is to only apply the coatings to the regions of the sheet which will form the blanks, whilst cutting the blanks as close to the edge of the coated regions as possible, but without cutting the coated region. However, it is difficult to maintain the edge of the coated region both close to and concentric with the cut-edge and any unevenness of the coating at the edge of the coated region can upset the drawing operation, causing off-centre drawing and wrinkles. Contact between un-coated bare metal adjacent to the edge of the blank and the clamping surfaces of the drawing tooling can also cause dirt to contaminate the closure.

SUMMARY

It is an objective of the present invention to provide a closure with a reduced risk of particles or hairs being formed at the cut edge. This may be achieved by having a reduced number or thickness of coating layers at the cut edge. Limiting one or more of the coating layers in such a way saves cost and helps avoid creation of coating particles and hairs by reducing the total coating thickness at the cut edge. Embodiments of the invention also enable the coating materials applied to the panel region to be optimised to prevent undesirable chemical reactions such as corrosion between the metal and the contents of the container, to avoid contamination or taint of the product, and to comply with food-contact legislation, without the need to withstand the drawing process. They also enable the coating materials applied to the skirt region to be optimised to withstand the drawing process and any curling, threading or lugging processes, and to adhere well adjacent to the cut-edge, without the need to meet all the requirements of the panel region. The sequence of application of each layer may be selected to best suit adhesion of the sealing material to the outer panel region.

According to an aspect of the invention, there is provided a metal closure comprising a panel and a depending side wall terminating in a cut edge, the inner surface of the closure having a plurality of coating layers applied such that at least one of the coating layers extends to the cut edge and the coating thickness at and in proximity to the cut edge is less than the thickness at one or more other regions of the inner surface.

According to a further aspect, there is provided a method of manufacturing a metal closure comprising a panel and a depending side wall terminating in a cut edge. A plurality of coating layers are applied to a metal sheet such that at least one of the coating layers extends to an edge to be cut and the coating thickness in proximity to that edge is less than the thickness at one or more regions inwardly of the edge to be cut. The sheet is cut at said edge to provide a blank; and the blank is formed into a closure including drawing the blank to provide a panel and a depending side wall terminating in the cut edge and such that the coating layers are present on an inner surface of the closure.

According to a further aspect, there is provided a metal closure comprising a panel and a depending side wall terminating in a cut edge, the inner surface of the closure having a plurality of coating layers applied such that one of the coating layers applied to the panel is not applied to the side wall.

According to a further aspect, there is provided a metal closure comprising a panel and a depending side wall terminating in a cut edge, the inner surface of the closure having a plurality of coating layers applied such that one of the coating layers applied to the side wall is not applied to the panel.

Further embodiments are provided in the appended claims.

DETAILED DESCRIPTION

Figure 1A:
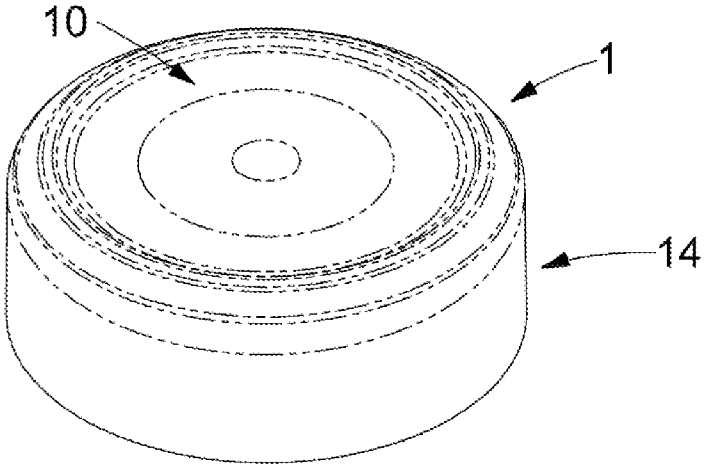
FIG. 1A is a perspective external view of a circular drawn closure shell.

FIG. 1A shows an exemplary closure 1 after the completion of the blanking and drawing steps. The closure has a circular top panel 10, and a side wall 14 depending from the periphery of the top panel. The top panel is substantially flat, but may contain raised or recessed features such as tamper-evident buttons or embossed decoration. Such a closure, possibly after completion of further steps to add lugs and/or threading to the side wall, provide a curl to the cut edge, etc, may be suitable for closing a container such as a jar or bottle.

Figure 1B:
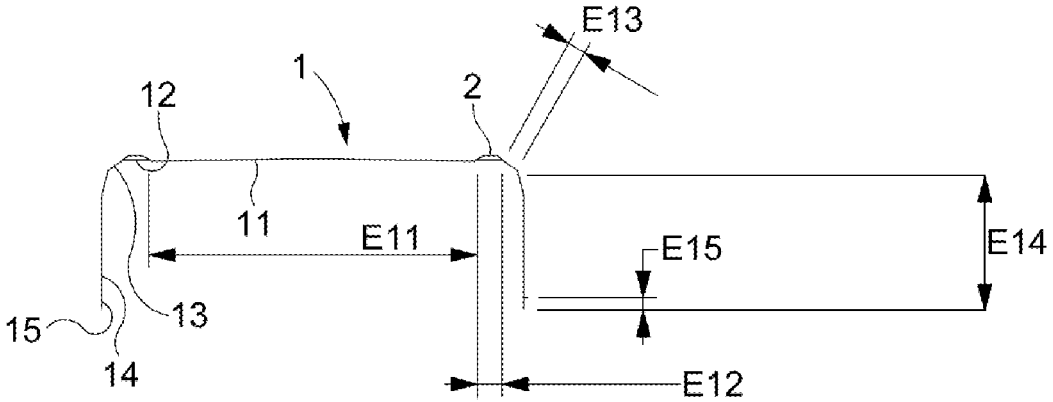
FIG. 1B is an illustrative cross section of a circular drawn closure shell perpendicular to the axis.

FIG. 1B is a cross section of the closure along its diameter, showing a sealing compound 2 which adheres to the underside of a raised ridge in the top panel, close to the periphery. The sealing compound is used to ensure a good seal with the container when the closure is in use, and is positioned to press against the rim of the container when the container is closed by the closure.

For the purposes of the below description, several regions of the closure will now be defined with reference to FIG. 1B:

A central panel region 11

An outer panel region 12 surrounding the central panel region 11. The sealing compound is adhered to the underside of this outer panel region.

An intermediate panel region 13 between the outer panel region 12 and the side wall 14.

A cut edge region 15 at the base of the sidewall.

The extent of each region (and of the side wall 14) is shown by dimensions indicated by corresponding numerals E11 to E15.

Closures of the type shown in FIGS. 1A and 1B are normally produced from a single sheet of coated and decorated sheet metal, which is cut into circular blanks ("blanked") and drawn to form the shape shown in FIGS. 1A and 1B.

Figure 1C:
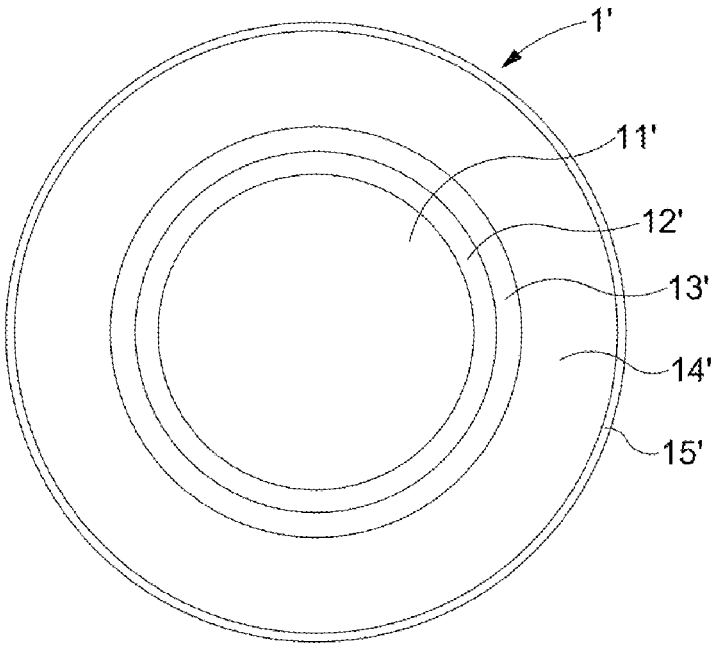
FIG. 1C is an illustrative axial view of a circular blank from which the closure shell is drawn.

FIG. 1C is a plan view of a blank 1' used to form the closure 1. Reference numerals 11' to 15' indicate regions of the blank which correspond to the regions indicated by reference numerals 11 to 15 in FIG. 1B when the blank is formed into a closure. As can be seen from FIG. 1C, the side wall is formed from an annular region of the blank extending outwardly from the intermediate region to the cut edge.

In a conventional closure, a plurality of coating layers are applied to the sheet metal in sequence, before the blank is cut. For the purposes of this disclosure, the sealing compound (which is only applied to the outer panel region) is not considered one of the coating layers. Generally, the coating layers will include one or more base coats and a top coat, which are selected to give desirable properties to the closure.

As described above, cutting blanks and drawing them into closures can form hairs and particles—in part due to the thickness of the coating layers. In order to mitigate this, an alternative construction for such closures is proposed here, in which a reduced thickness of coating layers is applied to the cut edge region compared to those applied in the central region. This may be achieved by using thinner layers in the cut edge region, or by using fewer layers in that region.

The principle of applying different coating layers to different regions of the closure blank can also be used to give layers with differing properties to the central panel region and the side wall region, as required.

For example, the central panel region may have layers which provide improved corrosion resistance, avoid contamination or tainting of the product, and comply with all relevant food-contact legislation. Preferred materials generally have greater cross-linking, improved barrier properties, and do not contain compounds such as Bisphenol A or other undesirable materials.

The side wall region may have layers which have a better ability to withstand the blanking and drawing processes, and any curling, threading or lugging processes, and resist corrosion caused by the processing of the containers. As the materials in this region will not normally be in contact with the food, they may contain materials which would be prohibited in the central region. Preferred materials would be flexible, well lubricated, and have a reduced tendency to forming particles or hairs.

One or more of the coating layers used in the side wall region may be omitted in the cut edge region, to further reduce the creation of particles or hairs when the blank is cut. However, there should be at least one layer present in the cut edge region which prevents corrosion of the closure.

The layers in the central panel region may extend at least partially into the outer panel region, to avoid any gaps in the coating which could cause food to contact the metal of the container. Similarly, the coating layers in the side wall region may extend slightly into the intermediate region or outer panel region to increase the tolerance to slight misalignments of the tooling during blanking and drawing. The overlapping and ordering of layers may be arranged to suit the materials being used.

Some sealing materials contain components such as plasticisers which weaken the coatings underneath. This means that the areas closest to the sealing material are often the most prone to corrosion. In order to combat this, one or more of the layers of the side wall region may extend to slightly within the central panel region in order to provide a further barrier between the sealing material and the top coat of the central panel region. Alternatively or additionally, a layer of special top coat may be applied to the outer panel region and slightly to either side in order to provide a good surface for the sealing material to adhere to and protect the other coatings from the effects of plasticisers.

Figure 2:
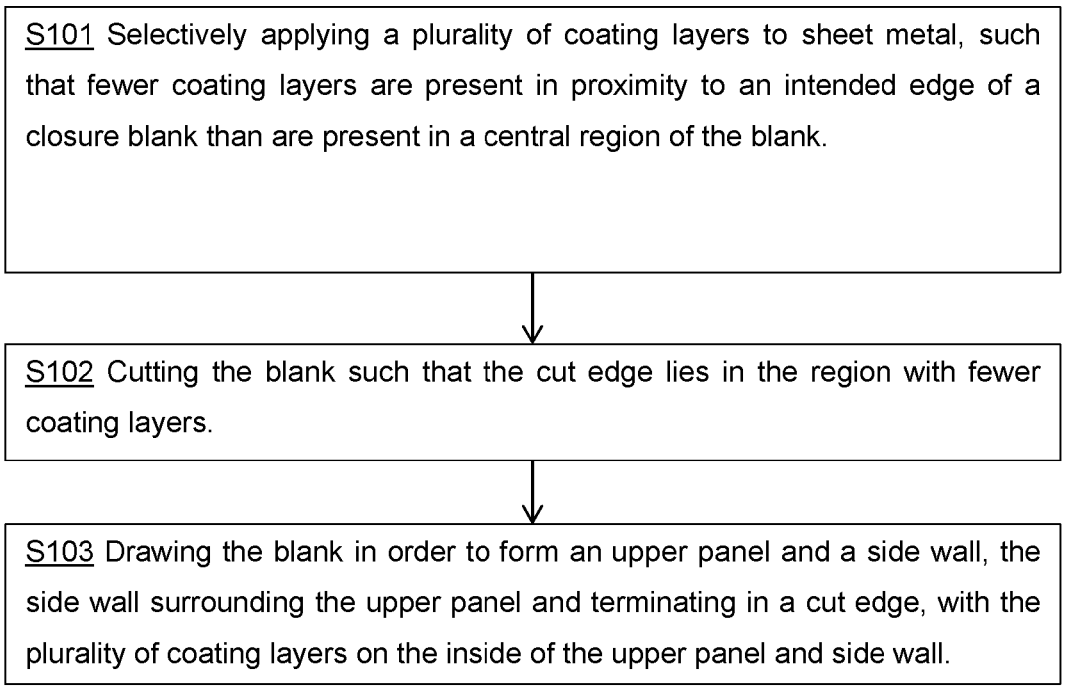
FIG. 2 is a flowchart of a method of manufacturing a closure.

The closure is manufactured from a sheet of metal. FIG. 2 is a flowchart of this process. In order to form the closure, the coatings are selectively applied to regions of the sheet metal S101, i.e. applying the coatings which are required on the central panel region to the region of the sheet metal which will be formed into the central panel region of the closure, applying the coatings which are required on the side wall to the region of the sheet metal which will be formed into the side wall of the closure, etc. The coatings are applied such that the coating layer thickness in proximity to an intended edge of a closure blank is less than the thickness at one or more other regions of the closure blank, e.g. by applying thinner layers and/or fewer layers in the cut edge region. Where a coating is present on multiple adjacent regions, it may be applied as a single layer to all of the required regions. The selective application may be accomplished by the use of cut-away rollers, with each roller being configured to transfer a coating to the required area for that coating. Coatings which are to be applied to the whole closure may be applied to the entirety of the sheet metal, or only to the regions which will form the blanks. Coatings which are present in the cut edge region may also be applied slightly beyond the border of the blanks, to allow for slight misalignments of the tooling.

Once the sheet metal is coated, it is cut into blanks S102 (such as the blank depicted in FIG. 1C), with the blanks being cut concentric to the regions to which the coatings are applied and the cut edge lying in the region with fewer coating layers. The sealing compound may be applied to the outer panel region before or after blanking and/or drawing. The blanks are then drawn S103 in order to form the closure by forming the side wall region into a side wall, with the coating layers on the inside of the closure, and adding other features as required. Additional steps such as lugging or threading of the closure may then be performed. The step of applying the sealing material may be carried out at any stage, and whilst sealing material is most commonly applied to closures after drawing the blank, the closure of the invention is additionally suited to the application of sealing material prior to blanking or drawing.

A selection of exemplary embodiments will now be presented with reference to FIGS. 3A to 3D. The particular materials and combinations disclosed in these embodiments are not intended to be limiting, and it should be appreciated that other combinations of layers are within the scope of the present disclosure. Any coatings shown as applied at the cut edge region 15' in the Figures is applied at least a short distance beyond the cut edge, and may be applied to all regions of the metal sheet which are not part of a blank. FIGS. 3A to 3D each show a cross section of a closure blank, with the coating layers presented in exploded view. The vertical dotted lines indicate the regions 11' to 15' of the closure blank 1'.

Figure 3A:
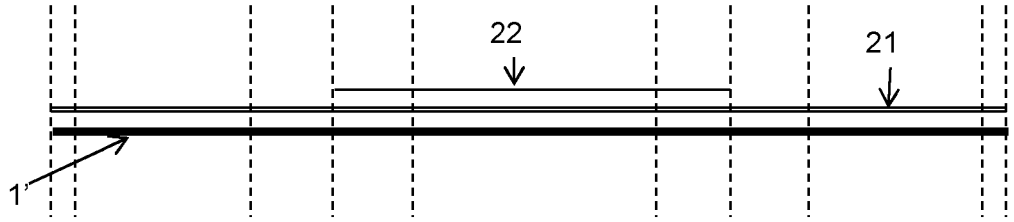

In one embodiment, as shown in FIG. 3A, one or two coats of an epoxy-based coating 21 are first applied to the entire sheet, and then a polyester based coating containing a dispersion of PVC 22 is applied to the sheet in circles corresponding to the central and outer panel regions, with a slight overlap into the intermediate regions. The PVC dispersion coating (commonly known as "organosol") allows the PVC based sealing material to adhere better to the outer panel region. As an alternative, an acrylic based coating containing a dispersion of PVC may be used in place of the polyester based coating.

Figure 3B:
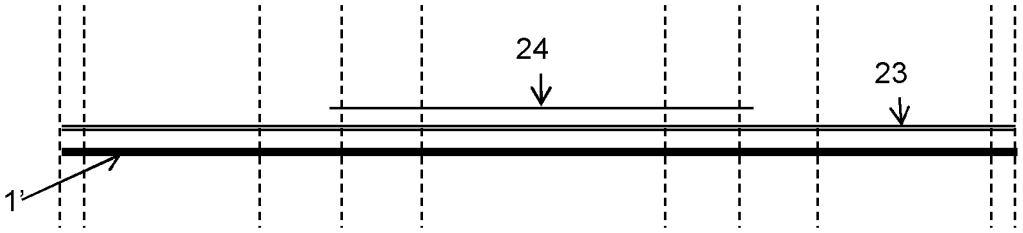

In a further embodiment, as shown in FIG. 3B, one or two coats of a polyester based coating 23 are first applied to the entire sheet, and then a polyester based coating containing a dispersion of PVC 24 is applied to the sheet in circles corresponding to the central and outer panel regions, with a slight overlap into the intermediate regions. The use of a polyester based coating in place of the epoxy based coating of the above embodiment avoids the presence of Bisphenol A.

Figure 3C:
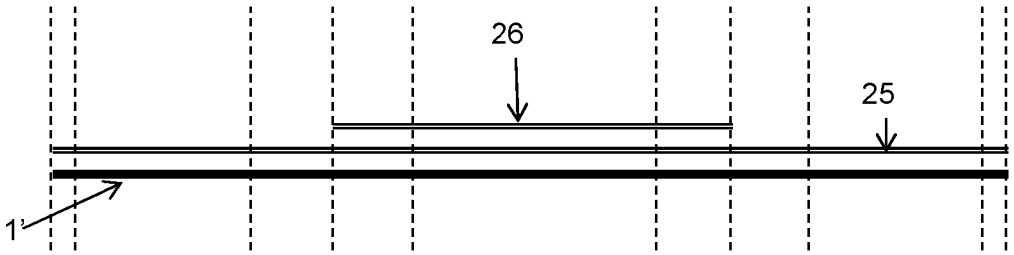

In a yet further embodiment, as shown in FIG. 3C, one or two coats of a polyester based coating 25 are applied to the entire sheet, and a further one or two coats are 26 applied to the central panel and outer panel regions only. The coats which are applied to the entire sheet may be formulated to provide greater flexibility and lubricity, and the coats which are applied to the central panel and outer panel regions may be formulated to provide greater corrosion resistance. These coats may be applied in any sequence. This embodiment is suited to the adhesion of a polyester-based elastomeric sealing material.

Figure 3D:
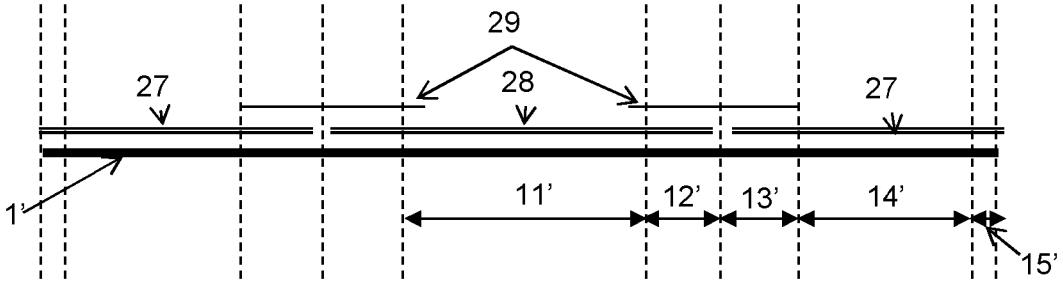

In a further embodiment, as shown in FIG. 3D, one or two coats of an epoxy based coating 27 are applied to the entire sheet except for the central panel and outer panel regions, one or two coats of a polyester based coating 28 are applied to the central panel and outer panel regions, and a further coat of a polyester based coating 29 formulated to resist the effects of plasticisers is applied to the intermediate and outer panel regions, and a short way into the central panel region. In FIG. 3D, the gap between the coatings at the border of the outer panel region has been exaggerated for clarity. In practice, the coatings may overlap slightly to ensure complete coverage.

Although the invention has been described in terms of preferred embodiments as set forth above, it should be understood that these embodiments are illustrative only and that the claims are not limited to those embodiments. It will be appreciated by the person of skill in the art that various modifications may be made to the above described embodiments without departing from the scope of the present invention. Each feature disclosed or illustrated in the present specification may be incorporated in the invention, whether alone or in any appropriate combination with any other feature disclosed or illustrated herein.

The invention claimed is:

1. A metal closure comprising a panel and a depending side wall terminating in a cut edge, the inner surface of the closure having a plurality of coating layers applied such that a first coating layer of the plurality of coating layers extends over an entire surface of the closure and a second coating layer of the plurality of coating layers extends over at least a central panel region of the panel, the second coating layer being spaced inwardly from the cut edge, wherein a coating thickness between the panel and the cut edge is less than a coating thickness on the central panel region of the panel, wherein the closure further has a sealing compound applied to an outer panel region on the top of the plurality of coating layers, the outer panel region being positioned between the panel and the side wall, and wherein the coating layers maintain adhesion of the sealing material to the outer panel region.

2. A closure according to claim 1, wherein the second coating layer applied to the panel is not applied to the side wall.

3. A closure according to claim 1, wherein the layers applied to the panel provide corrosion resistance and do not contain compounds which would contaminate or taint a product which the closure is intended to be used with.

4. A closure according to claim 1, wherein at least one of the coating layers applied to the side wall is not continuously applied to the panel.

5. A closure according to claim 1, wherein the layers applied to the side wall withstand a drawing, curling, threading, and/or lugging process.

6. A closure according to claim 1, wherein said coating layers comprise a layer selected to resist weakening by plasticizers of the sealing compound, and said layer is present at least in the outer panel region.

7. A closure according to claim 1, wherein the second coating layer coats an inner circular region or an inner annular region of the inner surface.

8. A closure according to claim 1 and comprising lugs or a screw thread on an inner surface of the side wall to permit attachment of the closure to a food or beverage container.

9. A metal closure comprising a panel and a depending side wall terminating in a cut edge, the depending side wall being positioned circumferentially about and extending radially outward from the panel to the cut edge, an inner surface of the closure having a plurality of coating layers applied such that at least one first coating layer of the plurality of coating layers is applied to a surface of the side wall, and at least one second coating layer of the plurality of coating layers is applied to a surface of the panel, wherein a coating thickness of the at least one first coating layer is less than a coating thickness of the at least one second coating layer.

10. The metal closure of claim 9, wherein one of the coating layers applied to the side wall is not applied to the panel.

11. A closure according to claim 1, wherein the first coating layer of the plurality of coating layers has a substantially uniform thickness over the surface of the closure.

12. A closure according to claim 1, wherein the second coating layer of the plurality of coating layers has a substantially uniform thickness over the panel.

13. The metal closure of claim 9, wherein the at least one first coating layer of the plurality of coating layers comprises a different material than the material of the at least one second coating layer of the plurality of coating layers.

14. A metal closure consisting essentially of:

a panel and a depending side wall terminating in a cut edge, a plurality of coating layers, an inner surface of the closure having the plurality of coating layers applied such that a first coating layer of the plurality of coating layers extends over an entire surface of the closure and a second coating layer of the plurality of coating layers extends over the panel spaced inwardly from the cut edge, wherein a coating thickness between the panel and the cut edge is less than a coating thickness on the panel, wherein the closure further has a sealing compound applied to an outer panel region on the top of the plurality of coating layers, the outer panel region being positioned between the panel and the side wall.

15. A metal closure consisting of:

a panel and a depending side wall terminating in a cut edge, a plurality of coating layers, an inner surface of the closure having the plurality of coating layers applied such that a first coating layer of the plurality of coating layers extends over an entire surface of the closure and a second coating layer of the plurality of coating layers extends over at least a central panel region of the panel, the second coating layer being spaced inwardly from the cut edge, wherein a coating thickness between the central panel region of the panel and the cut edge is less than a coating thickness on the panel, wherein the closure further has a sealing compound applied to an outer panel region on the top of the plurality of coating layers, the outer panel region being positioned between the panel and the side wall.

* * * * *